US010192385B2

(12) United States Patent
Yokote

(10) Patent No.: US 10,192,385 B2
(45) Date of Patent: Jan. 29, 2019

(54) BANKNOTE PROCESSING APPARATUS

(71) Applicant: Oki Electric Industry Co., Ltd., Tokyo (JP)

(72) Inventor: Takamoto Yokote, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 6 days.

(21) Appl. No.: 15/106,913

(22) PCT Filed: Nov. 6, 2014

(86) PCT No.: PCT/JP2014/079463
§ 371 (c)(1),
(2) Date: Jun. 21, 2016

(87) PCT Pub. No.: WO2015/145854
PCT Pub. Date: Oct. 1, 2015

(65) Prior Publication Data

US 2017/0116811 A1 Apr. 27, 2017

(30) Foreign Application Priority Data

Mar. 25, 2014 (JP) ..... 2014-061685

(51) Int. Cl.
*G07D 11/00* (2006.01)
*B65H 5/36* (2006.01)
*B65H 5/38* (2006.01)

(52) U.S. Cl.
CPC ..... *G07D 11/0081* (2013.01); *B65H 5/36* (2013.01); *B65H 5/38* (2013.01); *B65H 2402/10* (2013.01);
(Continued)

(58) Field of Classification Search
CPC .. G07D 9/00; G07D 11/0039; G07D 11/0027; G07D 11/0078; G07D 11/0084;
(Continued)

(56) References Cited

U.S. PATENT DOCUMENTS 5,301,618 A * 4/1994 Abendschein ..... B65H 5/062 109/55
6,695,307 B2 * 2/2004 Kanagawa ..... B65H 29/006 271/164
(Continued)

FOREIGN PATENT DOCUMENTS

JP 2006-206208 A 8/2006
JP 2013-242608 A 12/2013

*Primary Examiner* — Thomas A Morrison
(74) *Attorney, Agent, or Firm* — Rabin & Berdo, P.C.

(57) ABSTRACT

To provide a banknote processing apparatus for reducing occurrence of part damage involved by movement of a unit.

Provided is a banknote processing apparatus including: a first unit (10); a second unit (30); and a pair of transfer guides (20) configured to form a transfer conveyance path on which a banknote is conveyed between the first unit (10) and the second unit (30). The transfer conveyance path is formed between the pair of transfer guides (20). The transfer guide (20) has a first edge (26) at an opposite side to the transfer conveyance path and at the first unit (10) side, the first edge (26) coming closer to the transfer conveyance path as the first edge (26) nears an end at the first unit (10) side.

11 Claims, 12 Drawing Sheets

(52) U.S. Cl.
CPC .... *B65H 2402/62* (2013.01); *B65H 2404/611* (2013.01); *B65H 2404/6112* (2013.01); *B65H 2701/1912* (2013.01)

(58) Field of Classification Search
CPC ..... G07D 11/0036; G07D 11/0081; B65H 2404/6112; B65H 5/36; G07F 19/205
USPC ..... 194/206, 207; 382/135; 235/379; 271/264
See application file for complete search history.

(56) References Cited

U.S. PATENT DOCUMENTS

| | | | | |
|---|---|---|---|---|
| 8,764,011 | B2 * | 7/2014 | Michels | G07D 11/0003 271/264 |
| 2011/0266741 | A1 * | 11/2011 | Nakata | G07D 11/0006 271/3.14 |
| 2013/0307210 | A1 | 11/2013 | Takada | |

* cited by examiner

BANKNOTE PROCESSING APPARATUS

TECHNICAL FIELD

The present invention relates to a banknote processing apparatus.

BACKGROUND ART

In recent years, banknote processing apparatuses for customers to carry out a cash depositing process and a cash dispensing process have been installed in financial institutions. The banknote processing apparatus includes a customer interface section for transferring banknotes between a customer and the banknote processing apparatus, a classification section for classifying banknotes, banknote cassettes for storing banknotes, and the like. In the cash depositing process, the banknote processing apparatus conveys banknotes from the customer interface section to the banknote cassette. In the cash dispensing process, the banknote processing apparatus conveys banknotes from the banknote cassette to the customer interface section.

As an example of the banknote processing apparatuses, Patent Literature 1 has disclosed a banknote processing apparatus in which an upper unit including a customer interface section, a classification section, and the like is arranged above a lower unit including banknote cassettes. In this banknote processing apparatus, the lower unit can be drawn out of this banknote processing apparatus.

CITATION LIST

Patent Literature

Patent Literature 1: JP 2006-206208A

SUMMARY OF INVENTION

Technical Problem

For example, in order to draw out the upper unit and the lower unit from the banknote processing apparatus while the lower unit is covered by a safe, it is considered to provide transfer guides between the upper unit and the lower unit. The transfer guides are guides for transferring banknotes between the upper unit and the lower unit.

However, in the case where a staff puts one of the units drawn out of the banknote processing apparatus back into place in the banknote processing apparatus while a banknote is left behind between the transfer guides or in the unit, a part of the transfer guides or the unit may be damaged unfortunately. For example, when the staff puts one of the units back into place, the left-behind banknote is sandwiched between the transfer guides and the unit, and the staff further pushes the unit into place while the left-behind banknote is sandwiched. This causes the transfer guides and the unit to be mutually pulled via the left-behind banknote, and a part of the transfer guides or the unit may be damaged due to the pulling force unfortunately.

Therefore, a banknote processing apparatus capable of reducing occurrence of part damage involved by movement of a unit has been desired.

Solution to Problem

According to an aspect of the present invention, there is provided a banknote processing apparatus including: a first unit; a second unit; and a pair of transfer guides configured to form a transfer conveyance path on which a banknote is conveyed between the first unit and the second unit. The transfer conveyance path is formed between the pair of transfer guides. The transfer guide has a first edge at an opposite side to the transfer conveyance path and at the first unit side, the first edge coming closer to the transfer conveyance path as the first edge nears an end at the first unit side.

The transfer guide may have a second edge at an opposite side to the transfer conveyance path and at the second unit side, the second edge coming closer to the transfer conveyance path as the second edge nears an end at the second unit side.

The first edge or the second edge may be an inclined surface having an angle of 60 degrees or more with respect to a direction in which the transfer conveyance path has been formed.

The first unit may include a pair of first guides configured to form the transfer conveyance path in a nested manner with respect to the transfer guide. The first guide may have a third edge at an opposite side to the transfer conveyance path and at the transfer guide side, the third edge coming closer to the transfer conveyance path as the third edge nears an end at the transfer guide side.

The third edge may be an inclined surface having an angle of 60 degrees or more with respect to a direction in which the transfer conveyance path has been formed.

The second unit may include a pair of second guides configured to form the transfer conveyance path in a nested manner with respect to the transfer guide. The second guide may have a fourth edge at an opposite side to the transfer conveyance path and at the transfer guide side, the fourth edge coming closer to the transfer conveyance path as the fourth edge nears an end at the transfer guide side.

The fourth edge may be an inclined surface having an angle of 60 degrees or more with respect to a direction in which the transfer conveyance path has been formed.

The first unit and the second unit may be separable from the transfer guide in a predetermined direction different from a direction in which a banknote is conveyed on the transfer conveyance path.

One of the first unit and the second unit may include a customer interface section configured to transfer a banknote between a customer and the banknote processing apparatus. The other of the first unit and the second unit may include a plurality of banknote storage sections configured to store banknotes.

Advantageous Effects of Invention

As described above, according to the present invention, it is possible to reduce occurrence of part damage involved by movement of a unit.

DESCRIPTION OF EMBODIMENTS

Figure 1:
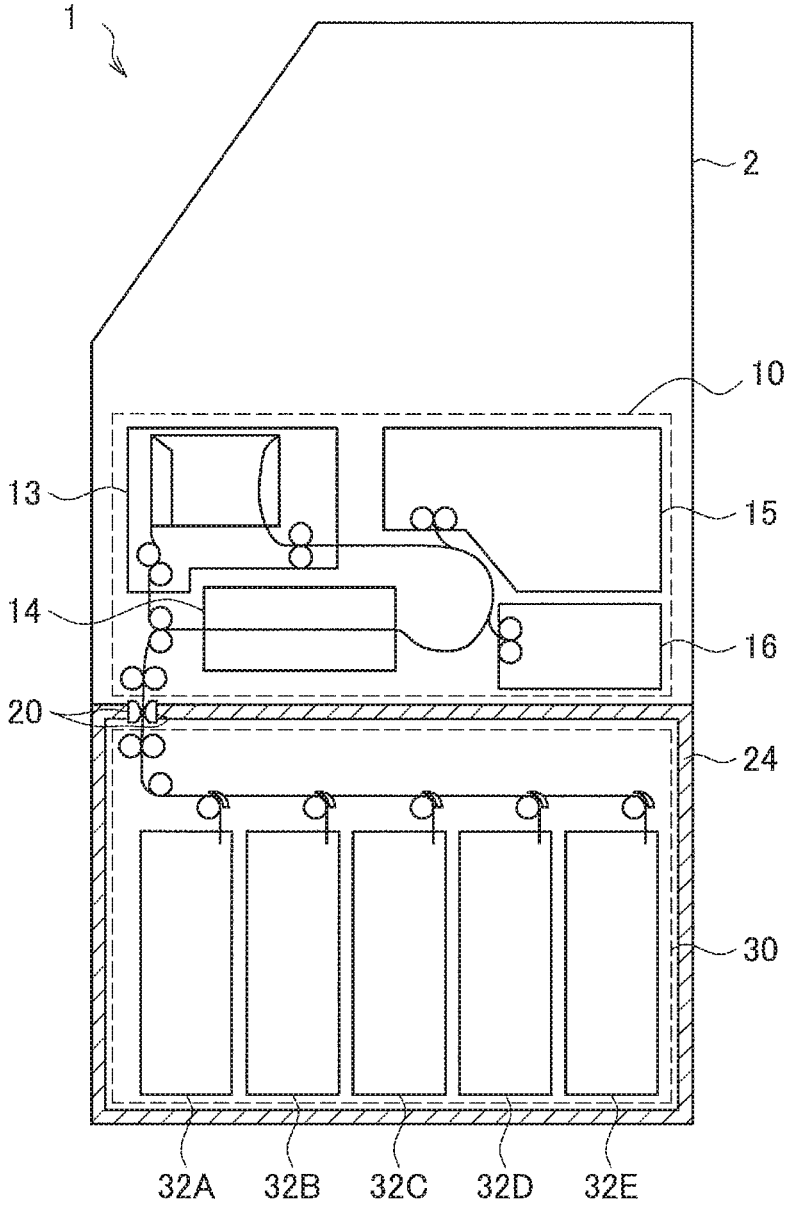
FIG. 1 is a diagram illustrating an internal configuration example of a banknote processing apparatus 1 according to an embodiment of the present invention.

Hereinafter, referring to the appended drawings, embodiments of the present invention will be described in detail. It should be noted that, in this specification and the appended drawings, structural elements that have substantially the same function and structure are denoted with the same reference numerals, and repeated explanation thereof is omitted.

In addition, in this specification and the drawings, structural elements that have substantially the same function and structure are sometimes distinguished from each other using different alphabets after the same reference numeral. However, when there is no need in particular to distinguish structural elements that have substantially the same function and structure, the same reference numeral alone is attached.

<1. Basic Configuration of Banknote Processing Apparatus>

Banknote processing apparatuses according to an embodiment of the present invention are installed in financial institutions, convenience stores, and the like, and connected to a host computer managed by the financial institution. The banknote processing apparatus according to the embodiment of the present invention is capable of carrying out a cash depositing process and a cash dispensing process by communicating with the host computer in response to customer operation. Hereinafter, with reference to FIGS. 1 to 3, an internal configuration of the banknote processing apparatus according to the embodiment of the present invention will be described first.

(1-1. Internal Configuration Example of Banknote Processing Apparatus)

FIG. 1 is a diagram illustrating an internal configuration example of a banknote processing apparatus 1 according to the embodiment of the present invention. As illustrated in FIG. 1, the banknote processing apparatus 1 includes a casing 2 in which an upper unit 10, a pair of transfer guides 20, a safe 24, and a lower unit 30 are arranged. Note that, one of the upper unit 10 and the lower unit 30 corresponds to a first unit of the banknote processing apparatus 1, and the other of the upper unit 10 and the lower unit 30 corresponds to a second unit of the banknote processing apparatus 1.

The upper unit 10 includes a customer interface section 13, a classification section 14, a temporary holding section 15, and a reject container 16. In addition, the upper unit 10 includes a conveyance section that connects the customer interface section 13, the classification section 14, the temporary holding section 15, and the reject container 16. The conveyance section is provided with the conveyance section including a conveyance path, a conveyance roller for conveying banknotes, and a drive mechanism for driving the conveyance roller. For example, the drive mechanism drives the conveyance roller by a rotating DC servo motor, a rotating pulse motor, or the like. The conveyance section is controlled by the banknote processing apparatus 1 to convey banknotes to a target conveyance destination.

In the cash depositing process, the customer interface section separates banknotes input by a customer from each other. In the cash dispensing process, the customer interface section accumulates banknotes to be returned to the customer.

The classification section 14 classifies banknotes passing through one by one. The banknotes travel bi-directionally. The classification section 14 can classify both banknotes conveyed from the customer interface section 13 side direction and banknotes conveyed from the opposite direction. The classification section 14 classifies denomination, authenticity (genuine bill/counterfeit bill), fatigue (normal bill/defective bill), feeding states (normal state/abnormal state), and the like of the banknotes conveyed through the conveyance path, and makes a determination of normality or a determination of rejection on the passing banknotes.

The temporary holding section 15 has both functions of separation and accumulation of banknotes. For example, the temporary holding section 15 temporarily accumulates (stores) banknotes that are separated from the customer interface section 13 during the cash depositing process and classified as normal by the classification section 14. The banknotes accumulated in the temporary holding section 15 are ejected in the case where a transaction is concluded, such as a case where the deposited banknotes have been put into a bank account. Subsequently, the banknotes pass through the classification section 14, and are conveyed to the banknote cassettes 32A to 32E or the like. Note that the temporary holding section 15 may adopt an accumulation type in which banknotes are sequentially piled up and accumulated, or a drum type in which banknotes are sequentially rolled up and stored.

The reject container 16 is a banknote storage section for accumulating banknotes classified as abnormal by the classification section 14 (determination of rejection).

The lower unit 30 includes the banknote cassettes 32A to 32E and the conveyance section, and is covered by the openable and closable safe 24. The back surface side of the safe 24 may be openable and closable by dial operation, for example.

The banknote cassettes 32 are banknote storage units in which banknotes can be stored according to denominations, the banknote cassettes 32 having both functions of accumulation and separation of banknotes. In addition, the banknote cassettes 32A to 32E may include a plurality of banknote cassettes for the same denomination. For example, the banknote cassettes 32A and 32C may be banknote cassettes for ten-thousand-yen bills, and the banknote cassettes 32B and 32D may be banknote cassettes for one-thousand-yen bills. In addition, the banknote cassettes 32A to 32E are configured to be attachable to and detachable from the banknote processing apparatus 1, and by detaching an attached banknote cassette 32 from the banknote processing apparatus 1 and attaching a banknote cassette 32 in which a sufficient amount of banknotes are stored to the banknote processing apparatus 1, the banknote processing apparatus 1 can be loaded with the banknotes.

The pair of transfer guides 20 is provided between the upper unit 10 and the lower unit 30, and is fixed to the safe 24. The pair of transfer guides 20 forms a transfer conveyance path for conveying banknotes between the upper unit 10 and the lower unit 30. For example, in the cash depositing process, the transfer guides 20 transfer banknotes from the upper unit 10 to the lower unit 30 when the banknotes are conveyed from the classification section 14 to the banknote cassettes 32. In the cash dispensing process, the transfer guides 20 transfer banknotes from the lower unit 30 to the upper unit 10 when the banknotes are conveyed from the banknote cassettes 32 to the customer interface section 13.

Figure 2:
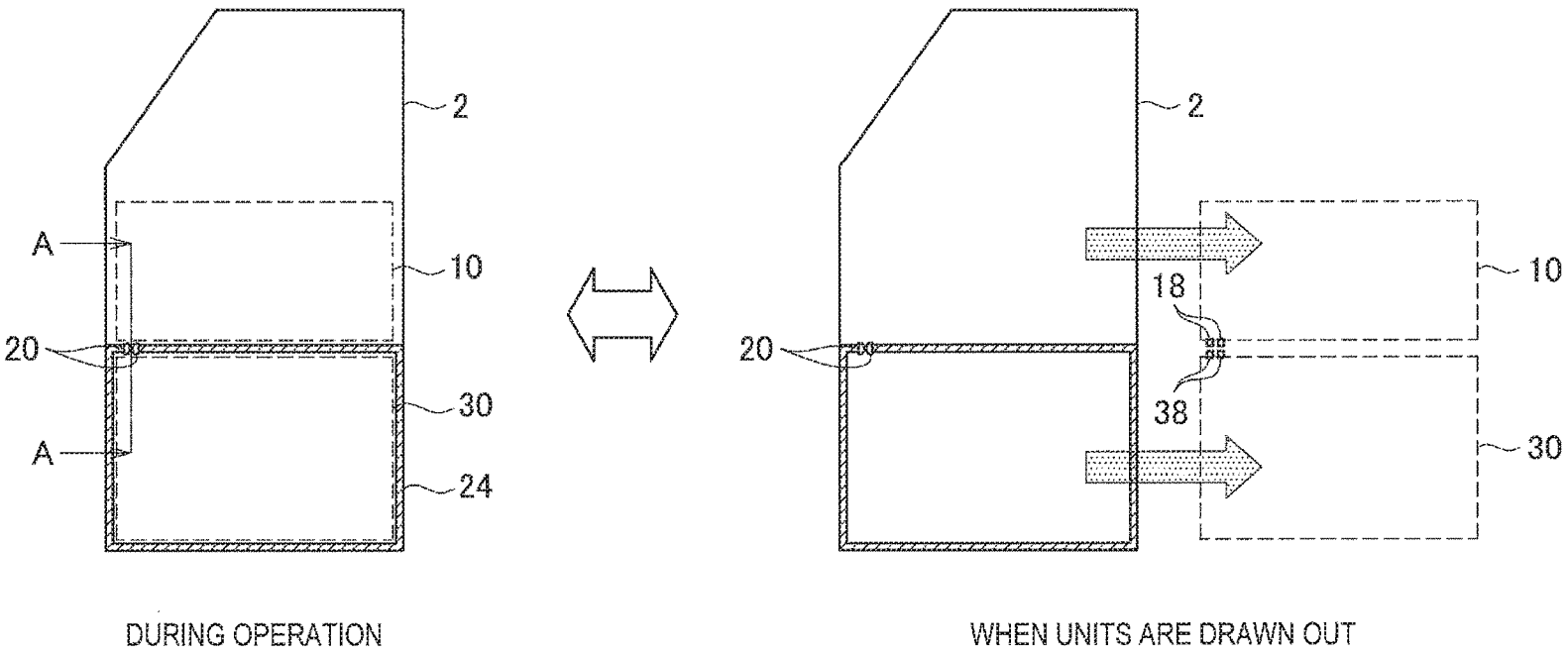
FIG. 2 is an explanatory diagram illustrating a state where each unit is drawn out.

As illustrated in FIG. 2, the upper unit 10 and the lower unit 30 are stored in place in the banknote processing apparatus 1 while the banknote processing apparatus 1 is operating. On the other hand, the upper unit 10 and the lower unit 30 may be separated from the transfer guides 20 by being drawn out in a predetermined direction (for example, orthogonal direction) different from a direction in which banknotes are conveyed on the transfer conveyance path. For example, as illustrated in FIG. 2, the upper unit 10 and the lower unit 30 can be drawn out by a slide mechanism (not illustrated) toward the back surface side of the banknote processing apparatus 1 for the purpose of maintenance or the like. Note that, the direction in which the upper unit 10 and the lower unit 30 can be drawn out is not limited to the direction illustrated in FIG. 2. The upper unit 10 and the lower unit 30 can be drawn out toward the front side or the lateral side of the banknote processing apparatus 1.

FIG. 1 and FIG. 2 illustrate the upper unit 10 and the lower unit 30 arranged in the vertical direction as an example of the first unit and the second unit of the banknote processing apparatus 1. Alternatively, the first unit and the second unit may be arranged in a horizontal direction. In this case, the first unit and the second unit can be drawn out toward the upper side or the lower side of the banknote processing apparatus 1.

Figure 3:
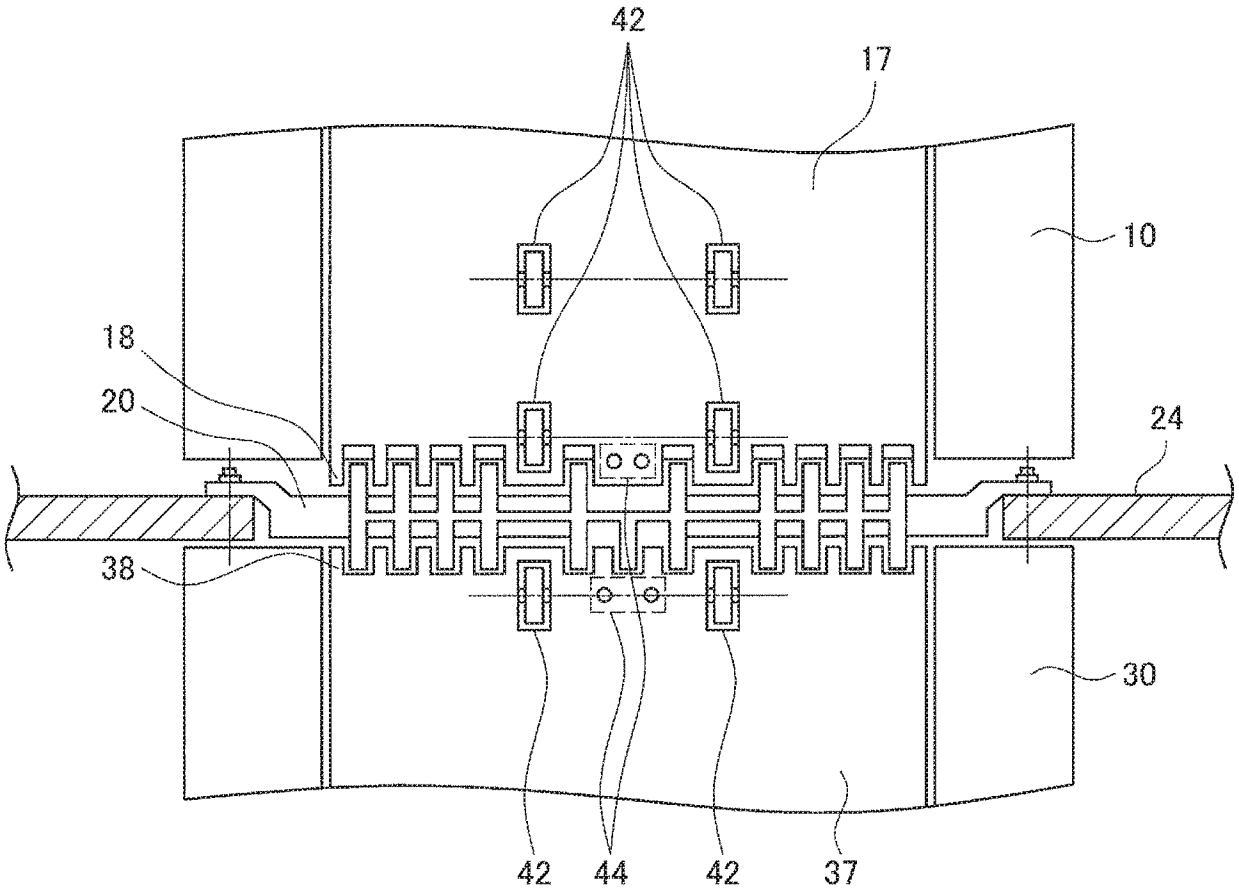
FIG. 3 is an explanatory diagram illustrating an A-A cross section illustrated in FIG. 2.

FIG. 3 is an explanatory diagram illustrating an A-A cross section illustrated in FIG. 2. As illustrated in FIG. 3, the upper unit 10 includes an upper conveyance section 17 in which conveyance rollers 42 for conveying banknotes and a left-behind sensor 44 for detecting a left-behind banknote are included. As illustrated in FIG. 2 and FIG. 3, a pair of comb-like upper guides 18 is provided at an end of the upper conveyance section 17 at the transfer guides 20 side. The pair of comb-like upper guides 18 forms the transfer conveyance path in a nested manner with respect to the transfer guides 20.

In a similar way, the lower unit 30 includes a lower conveyance section 37 in which conveyance rollers 42 for conveying banknotes and a left-behind sensor 44 for detecting a left-behind banknote are included. As illustrated in FIG. 2 and FIG. 3, a pair of comb-like lower guides 38 is provided at an end of the lower conveyance section 37 at the transfer guides 20 side. The pair of comb-like upper guides 38 forms the transfer conveyance path in a nested manner with respect to the transfer guides 20.

(1-2. Background)

Comparative examples with respect to the embodiment of the present invention include a banknote processing apparatus having transfer guides whose configuration is different from the embodiment of the present invention. However, in the case where a staff puts an upper unit drawn out of the banknote processing apparatus according to the comparative example back into place in the banknote processing apparatus while a banknote is left behind between the transfer guides or in the upper unit, a part of the transfer guides or the upper unit may be damaged unfortunately. Next, such an issue is described in detail with reference to FIG. 4 and FIG. 5.

Figure 4:
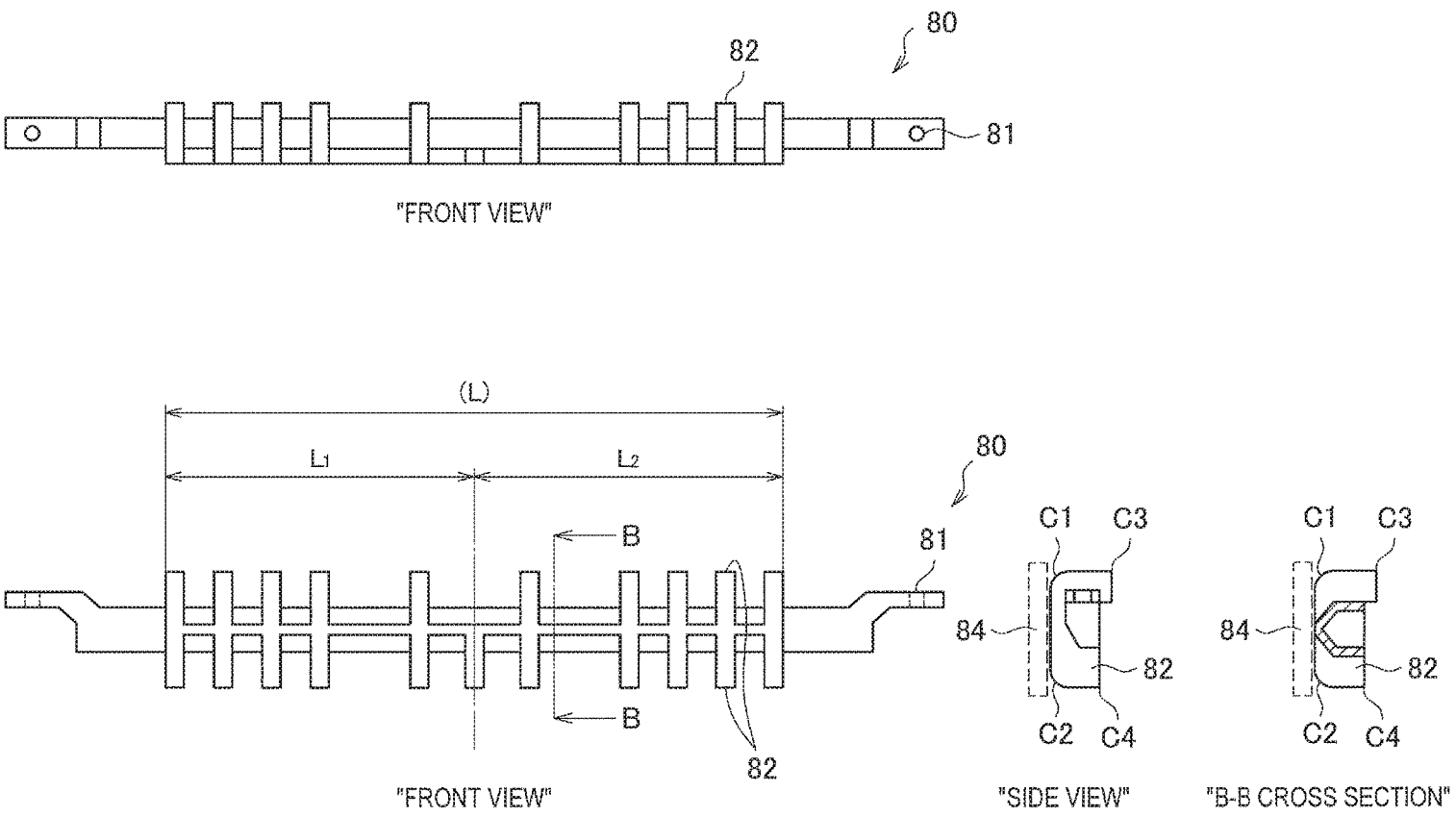
FIG. 4 is an explanatory diagram illustrating a configuration of a transfer guide according to a comparative example.

FIG. 4 is an explanatory diagram illustrating a configuration of a transfer guide 80 according to the comparative example. As illustrated in FIG. 4, the transfer guide 80 according to the comparative example includes fixed sections 81 to be fixed to the safe 24 and guide pieces 82 that are separate in the width direction of a transfer conveyance path 84. The guide pieces 82 are arranged from the center of the transfer guide 80 outward to the left and to the right in the same width (L1 and L2).

In addition, as illustrated in a side view and a B-B cross-sectional view in FIG. 4, each of the guide pieces 82 has rounded corners C1 and C2 at the transfer conveyance path 84 side. On the other hand, with regard to corners C3 and C4 of each of the guide pieces 82 at the opposite side to the transfer conveyance path 84 side, sides in the horizontal direction are perpendicular to sides in the vertical direction.

Figure 5:
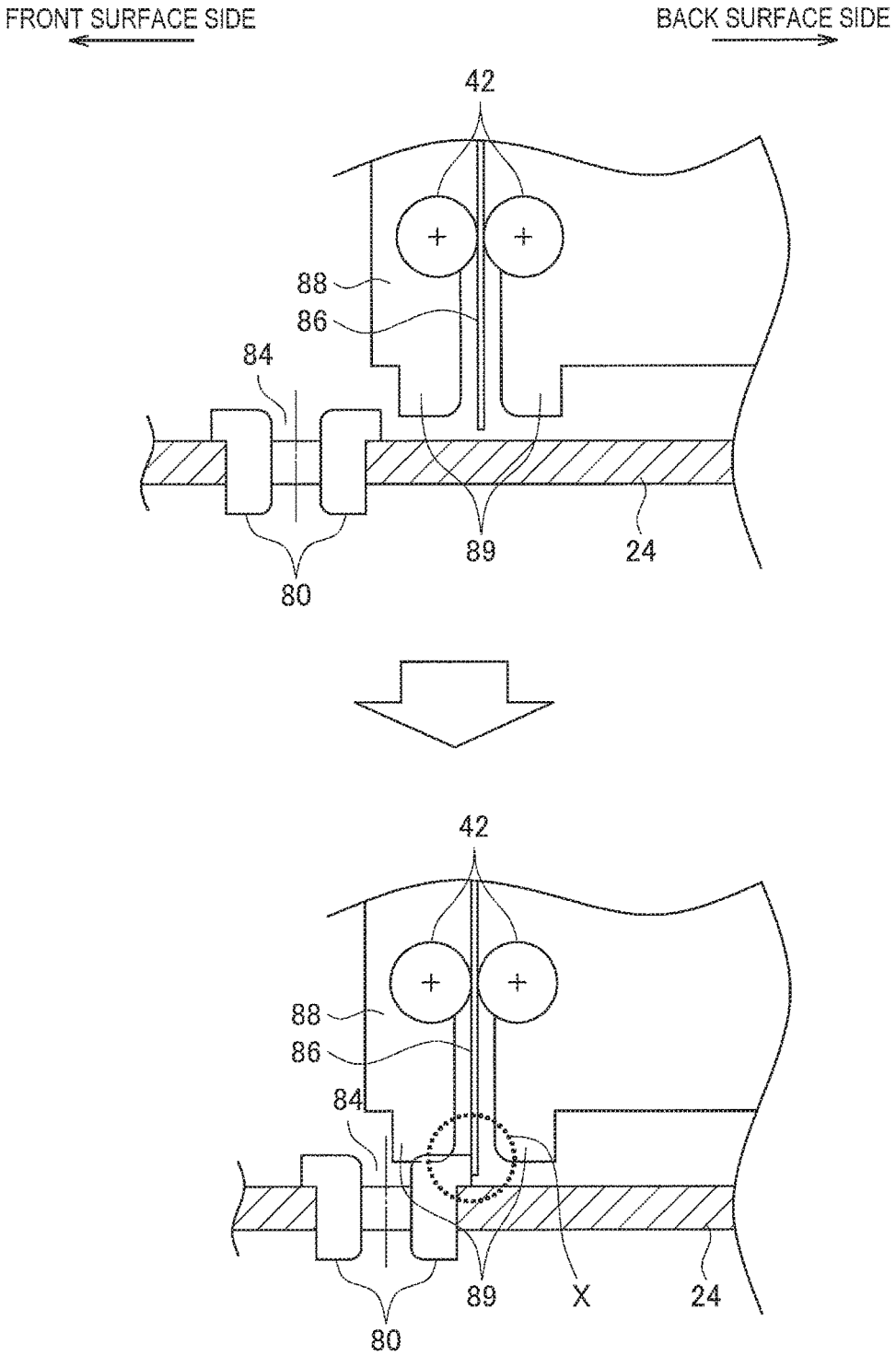
FIG. 5 is an explanatory diagram illustrating a process of putting an upper unit drawn out of a banknote processing apparatus according to a comparative example back into the banknote processing apparatus.

FIG. 5 is an explanatory diagram illustrating a process of putting an upper unit 88 drawn out of the banknote processing apparatus according to the comparative example back into the banknote processing apparatus. As illustrated in the upper side of FIG. 5, sometimes a left-behind banknote 86 may be in the drawn out upper unit 88. As illustrated in the lower side of FIG. 5, when a staff puts the upper unit back into place in the banknote processing apparatus while there is the left-behind banknote 86 as described above, the left-behind banknote 86 may be sandwiched between the upper guides 89 and a side surface of the transfer guide 80 (guide piece 82) opposite to the transfer conveyance path 84 side (portion X illustrated in FIG. 5).

As described above, in the side surface of the transfer guide 80 opposite to the transfer conveyance path 84 side, the sides in the horizontal direction are perpendicular to the sides in the vertical direction. Therefore, the left-behind banknote 86 comes into contact with the surface of the transfer guide 80 perpendicular to a horizontal force to press the upper unit 88. This increases a force to sandwich the left-behind banknote 86 between the transfer guide 80 and the upper unit 88. In addition, the left-behind banknote 86 is also sandwiched between the conveyance rollers 42, and therefore a force according to inertial forces of the conveyance rollers 42 is also applied to the left-behind banknote 86.

When the upper unit 88 is further pushed while the left-behind banknote 86 is strongly sandwiched between the transfer guide 80 and the upper unit 88 as described above, the transfer guide 80 and the upper unit 88 may be mutually pulled via the left-behind banknote 86, and an axis of the transfer guide 80 may bow toward the transfer conveyance path 84 side, unfortunately. What is worse is that the fixed section 81 of the transfer guide 80 may be damaged. In addition, the damaged transfer guide 80 leads a problem that a jam easily occurs while using the banknote processing apparatus. The example in which the upper unit 88 in which the left-behind banknote 86 remains is put back into the banknote processing apparatus has been described. A similar case may also happen in the case where a lower unit in which the left-behind banknote 86 remains is put back into the banknote processing apparatus.

In view of the foregoing situation, the present inventor has conceived the banknote processing apparatus 1 according to the embodiment of the present invention. A modified shape of the transfer guides 20 of the banknote processing apparatus 1 according to the embodiment of the present invention can reduce occurrence of part damage involved by movement of a unit. Hereinafter, the detailed configuration of the banknote processing apparatus 1 according to the embodiment of the present invention will be described.

<2. Detailed Configuration of Banknote Processing Apparatus>

Figure 6:
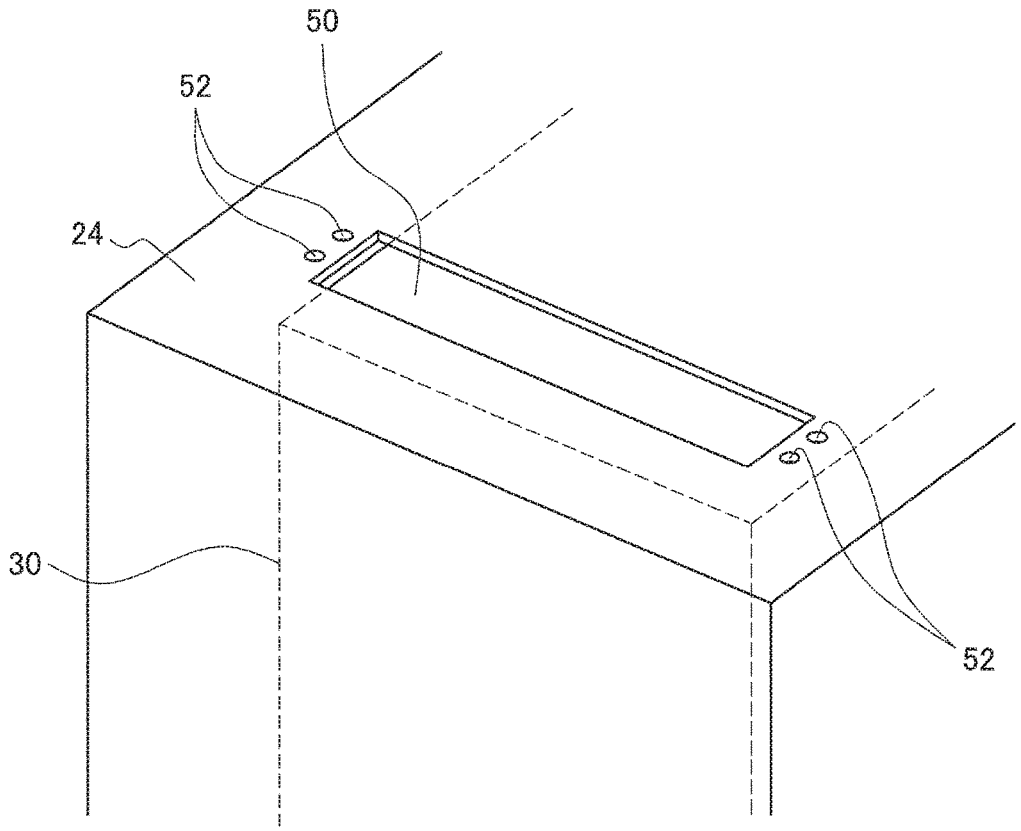
FIG. 6 is an explanatory diagram illustrating a configuration of a safe of a banknote processing apparatus.

FIG. 6 is an explanatory diagram illustrating the configuration of the safe 24 of the banknote processing apparatus 1. As illustrated in FIG. 6, the safe 24 includes an opening 50 and screw holes 52. The opening 50 is a space in which the transfer guides 20 are to be installed. Two screw holes 52 are provided along each short side of the opening 50.

Figure 7:
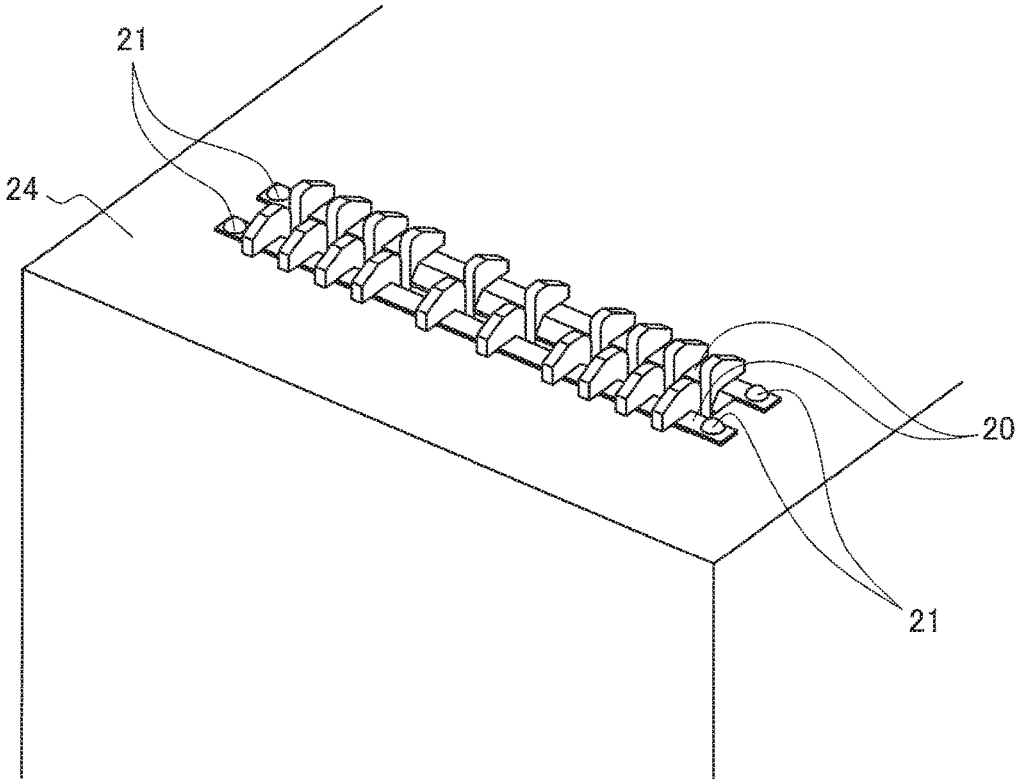
FIG. 7 is an explanatory diagram illustrating a state where transfer guides according to an embodiment of the present invention are installed in a safe.

FIG. 7 is an explanatory diagram illustrating a state where the transfer guides 20 according to the embodiment of the present invention are installed in the safe 24 described with reference to FIG. 6. As illustrated in FIG. 7, the pair of transfer guides 20 that face to each other is installed in the opening 50 of the safe 24, and the transfer conveyance path is formed between the pair of transfer guides 20. The transfer guides 20 are fixed to the safe 24 via fixed sections 21 and the screw holes 52 of the safe 24. Hereinafter, with reference to FIG. 8, the detailed configuration of the transfer guides 20 according to the embodiment of the present invention will be described.

Figure 8:
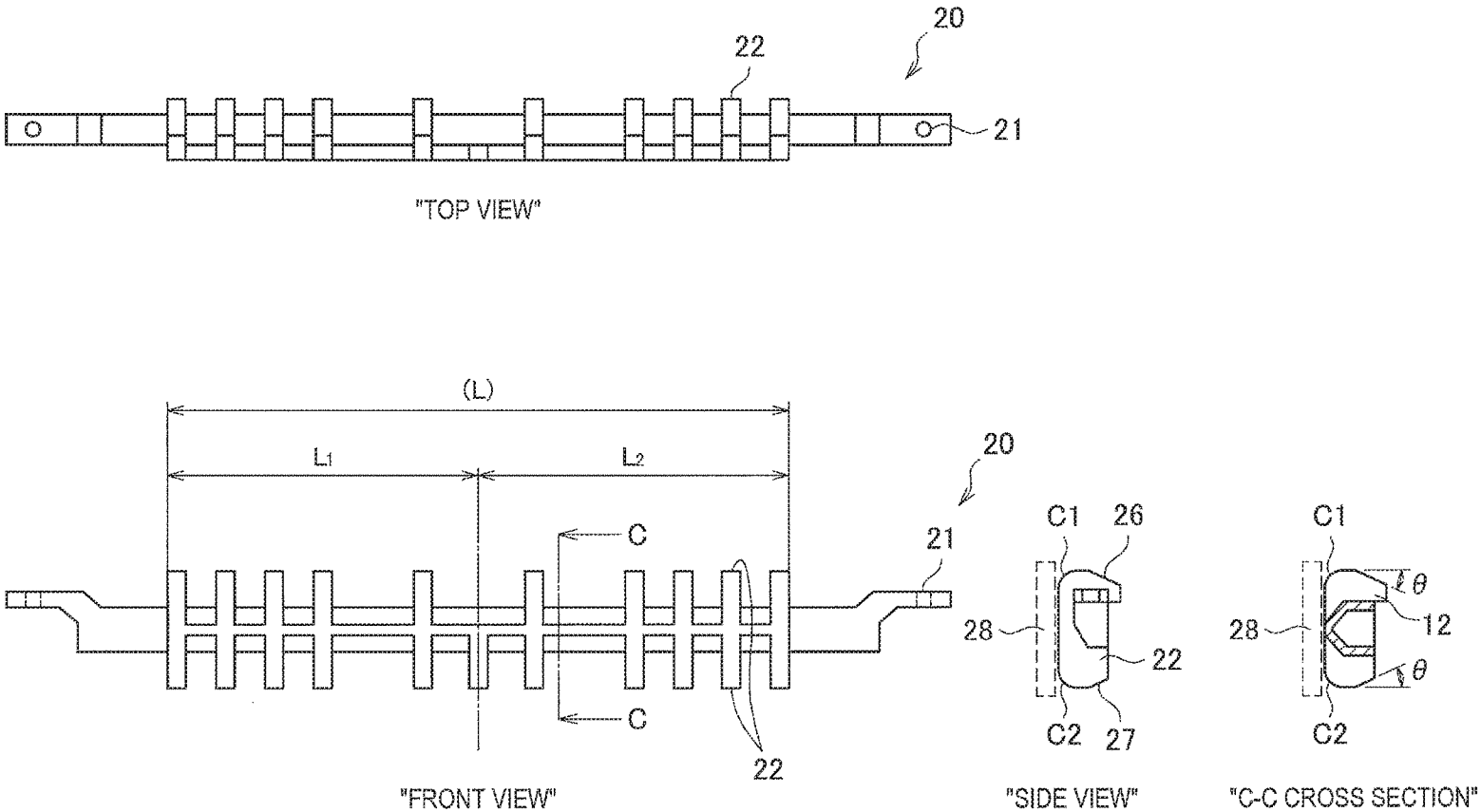
FIG. 8 is an explanatory diagram illustrating a configuration of a transfer guide according to an embodiment of the present invention.

FIG. 8 is an explanatory diagram illustrating the configuration of the transfer guide 20 according to the embodiment of the present invention. As illustrated in FIG. 8, the transfer guide 20 according to the embodiment of the present invention includes fixed sections 21 to be fixed to the safe 24 and guide pieces 22 that are separate in the width direction of the transfer conveyance path. The guide pieces 22 are arranged from the center of the transfer guide 20 outward to the left and to the right in the same width (L1 and L2).

In addition, as illustrated in a side view and a C-C cross-sectional view in FIG. 8, each of the guide pieces 22 has rounded corners C1 and C2 at the transfer conveyance path 28 side. Each of the guide pieces also has an upper edge 26 at an opposite side to the transfer conveyance path 28 side and at the upper unit 10 side, the upper edge 26 coming closer to the transfer conveyance path 28 as the upper edge 26 nears the upper unit 10 side. Each of the guide pieces also has a lower edge 27 at an opposite side to the transfer conveyance path 28 side and at the lower unit 30 side, the lower edge 27 coming closer to the transfer conveyance path 28 as the lower edge 27 nears the lower unit 30 side. One of the upper edge 26 and the lower edge 27 corresponds to a first edge, and the other of the upper edge 26 and the lower edge 27 corresponds to a second edge.

The upper edge 26 may be an inclined surface as illustrated in FIG. 8. The angle of the inclined surface with respect to the horizontal direction may be 30 degrees or less. In other words, the angle of the inclined surface with respect to the transfer conveyance path 28 may be 60 degrees or more. In a similar way, the lower edge 27 may be an inclined surface as illustrated in FIG. 8. The angle of the inclined surface with respect to the horizontal direction may be 30 degrees or less. In other words, the angle of the inclined surface with respect to the transfer conveyance path 28 may be 60 degrees or more.

Figure 9:
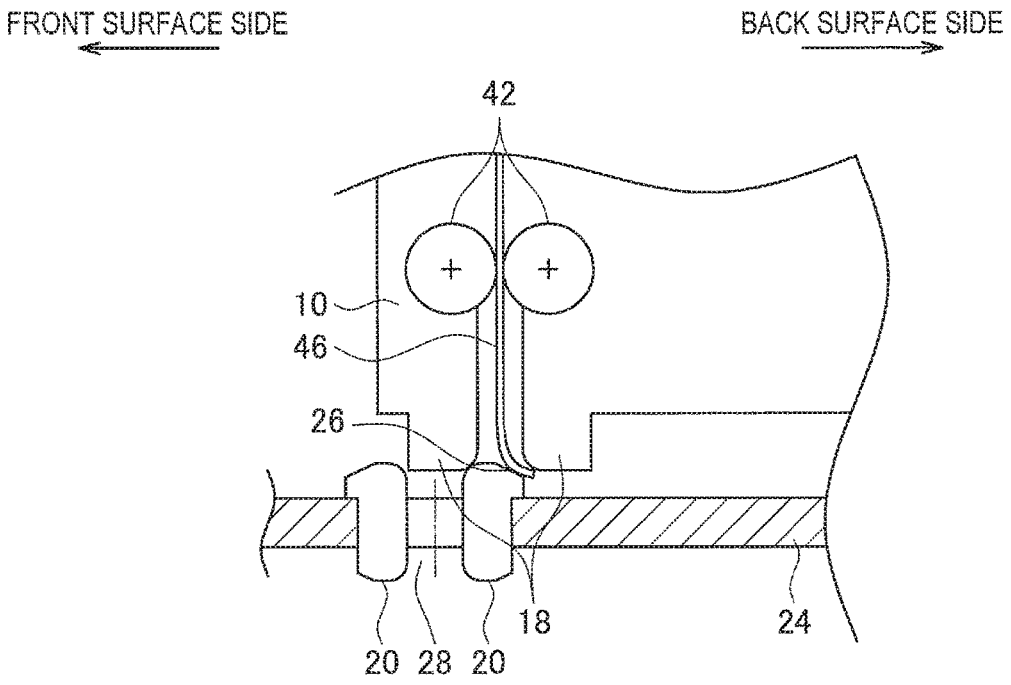
FIG. 9 is an explanatory diagram illustrating action of transfer guides according to an embodiment of the present invention.

According to this configuration, it is possible to reduce occurrence of part damage involved by movement of the upper unit 10 or the lower unit 30. For example, as illustrated in FIG. 9, when a staff puts the drawn out upper unit 10 back into place in the banknote processing apparatus 1 while the left-behind banknote 46 is in the upper unit 10, the left-behind banknote 46 may be sandwiched between the upper edge 26 of the transfer guide 20 and the upper guides 18 of the upper unit 10. However, the upper edge 26 is the inclined surface having the angle of 30 degrees or less with respect to the horizontal direction. Therefore, the left-behind banknote 46 deforms, and a component force applied to the upper edge 26 by a horizontal force to press the upper unit 10 is eased. As a result, a force to sandwich the left-behind banknote 46 between the transfer guide 20 and the upper unit 10 becomes weaker than the comparative example described with reference to FIG. 5. Accordingly, a force to mutually pull the transfer guide 20 and the upper unit 10 via the left-behind banknote 46 in the case where the upper unit 10 is further pushed also becomes weak. Therefore, it is possible to reduce bow of the transfer guide 20 and occurrence of part damage of the transfer guide 20.

The example in which the staff puts the upper unit 10 back into place in the banknote processing apparatus while the left-behind banknote 46 is in the upper unit 10 has been described. In addition, it is also possible to reduce bow of the transfer guide 20 and occurrence of part damage of the transfer guide 20 due to action of the lower edge 27 similar to the action of the upper edge 26, in the case where the staff puts the lower unit 30 back into place in the banknote processing apparatus while the left-behind banknote 46 is in the lower unit 30.

Note that, each of the upper edge 26 and the lower edge 27 may have a curved surface shape instead of the inclined surface. According to this configuration, it is possible to reduce the angle of the horizontal force to press the upper unit 10 with respect to the upper edge 26, and the angle of the horizontal force to press the lower unit 30 with respect to the lower edge 27. Therefore, the force to sandwich the left-behind banknote 46 is eased, and it is possible to reduce bow of the transfer guide 20 and occurrence of part damage of the transfer guide 20.

With reference to FIG. 9, the configuration has been described focusing on the transfer guide 20 at the back surface side. In a similar way, the transfer guide 20 at the front surface side may also have the upper edges 26 and the lower edges 27. According to this configuration, it is also possible to reduce bow of the transfer guide 20 at the front surface side and occurrence of part damage of the transfer guide 20 in the case where the upper unit 10 and the lower unit 30 can be drawn out toward the front side of the banknote processing apparatus 1.

<3. Application Example>

The embodiment of the present invention has been explained above. Next, an application example of the embodiment of the present invention will be described. Hereinafter, with reference to FIG. 10, a problem of the banknote processing apparatus according to the comparative example will be revealed, and the configuration of the banknote processing apparatus 1 according to the application example will be described.

(3-1. Background)

Figure 10:
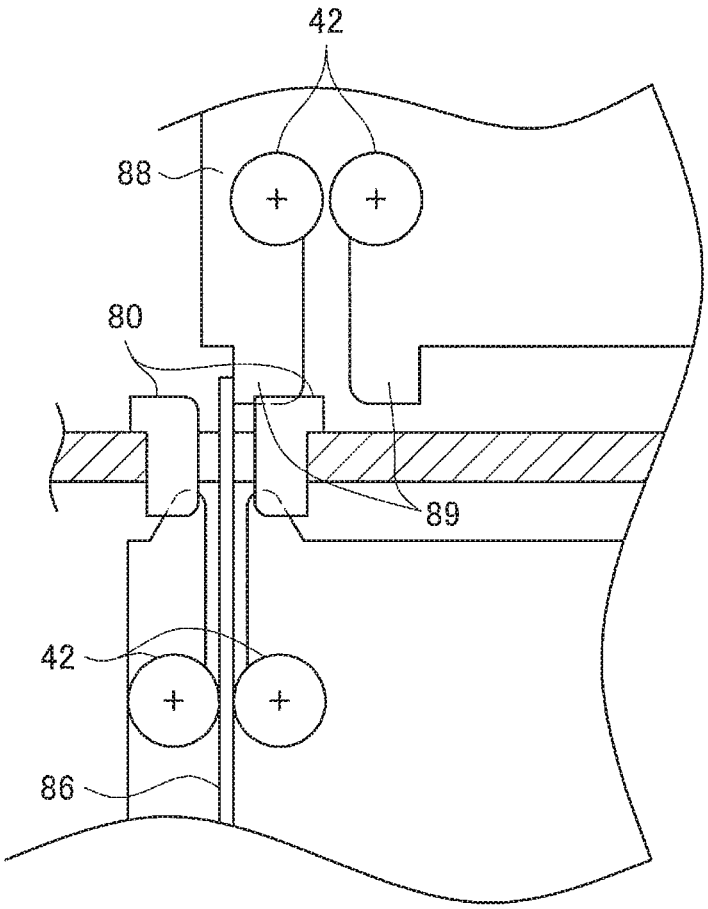
FIG. 10 is an explanatory diagram illustrating a process of putting an upper unit drawn out of a banknote processing apparatus according to a comparative example back into the banknote processing apparatus.

As illustrated in FIG. 10, when a staff puts the upper unit 88 back into place in the banknote processing apparatus according to the comparative example while there is the left-behind banknote 48 between the transfer guides 80, the left-behind banknote 86 is sandwiched between the transfer guides 80 and a side surface of the upper guide 89 opposite to the transfer conveyance path side.

As illustrated in FIG. 10, in the side surface of the transfer guide 89 opposite to the transfer conveyance path side, the sides in the horizontal direction are perpendicular to the sides in the vertical direction. Therefore, the left-behind banknote 86 comes into contact with a surface of the upper guide 89 perpendicular to a horizontal force to press the upper unit 88. This increase a force to sandwich the left-behind banknote 86 between the transfer guides 80 and the upper unit 88. In addition, the left-behind banknote 86 is also sandwiched between the conveyance rollers 42, and therefore a force according to inertial forces of the conveyance rollers 42 is also applied to the left-behind banknote 86.

When the upper unit 88 is further pushed while the left-behind banknote 86 is strongly sandwiched between the transfer guides 80 and the upper unit 88 as described above, the transfer guides 80 and the upper unit 88 may be mutually pulled via the left-behind banknote 86, and the upper guide 89 may bow toward a side opposite to the left-behind banknote 86 side, unfortunately. What is worse is that the upper guide 89 may be damaged. The upper unit 88 is equipped with the conveyance rollers 42, the left-behind sensor 44, and a sensor cord (not illustrated). Therefore, part replacement in the case where the upper guide 89 is damaged is more troublesome than the case where the transfer guide 80 is damaged. The example in which the upper unit 88 is put back into the banknote processing apparatus in which the left-behind banknote 86 remains has been described. A similar case may also happen in the case where a lower unit is put back into the banknote processing apparatus in which the left-behind banknote 86 remains.

On the other hand, the banknote processing apparatus 1 according to the application example can reduce occurrence of part damage involved by movement of a unit while the left-behind banknote 46 remains at the transfer guides 20 side. Hereinafter, with reference to FIG. 10 and FIG. 11, the configuration of the banknote processing apparatus 1 according to the application example will be described.

(3-2. Configuration of Banknote Processing Apparatus According to Application Example)

Figure 11:
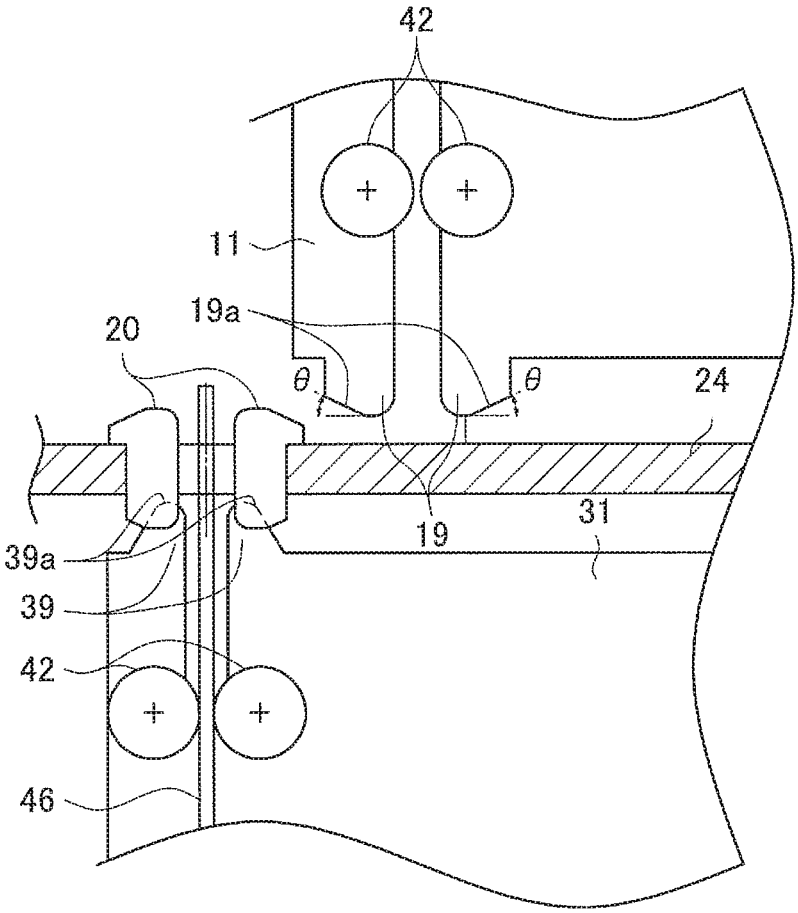
FIG. 11 is an explanatory diagram illustrating a cross-sectional view of a periphery of transfer guides of a banknote processing apparatus 1 according to an application example.

FIG. 11 is an explanatory diagram illustrating a cross-sectional view of a periphery of the transfer guides 20 of the banknote processing apparatus 1 according to the application example. As illustrated in FIG. 11, an upper unit 11 of the banknote processing apparatus 1 according to the application example includes upper guides 19 at an end of the transfer guides 20 side. Each of the upper guides has an edge 19*a* at an opposite side to the conveyance path side and at the transfer guides 20 side, the edge 19*a* coming closer to the conveyance path as the edge 19*a* nears the transfer guides 20 side. A lower unit 31 of the banknote processing apparatus 1 according to the application example includes lower guides 39 at an end of the transfer guides 20 side. Each of the lower guides 39 has an edge 39*a* at an opposite side to the conveyance path side and at the transfer guides 20 side, the edge 39*a* coming closer to the conveyance path as the edge 39*a* nears the transfer guides 20 side. One of the edge 19*a* and the edge 39*a* corresponds to a third edge, and the other of the edge 19*a* and the edge 39*a* corresponds to a fourth edge.

The edges 19*a* of the upper guides 19 may be inclined surfaces as illustrated in FIG. 11. The angle of the inclined surface with respect to the horizontal direction may be 30 degrees or less. In other words, the angle of the inclined surface with respect to the conveyance path may be 60 degrees or more. In a similar way, the edges 39*a* may be inclined surfaces. The angle of the inclined surface with respect to the horizontal direction may be 30 degrees or less. In other words, the angle of the inclined surface with respect to the conveyance path may be 60 degrees or more.

Figure 12:
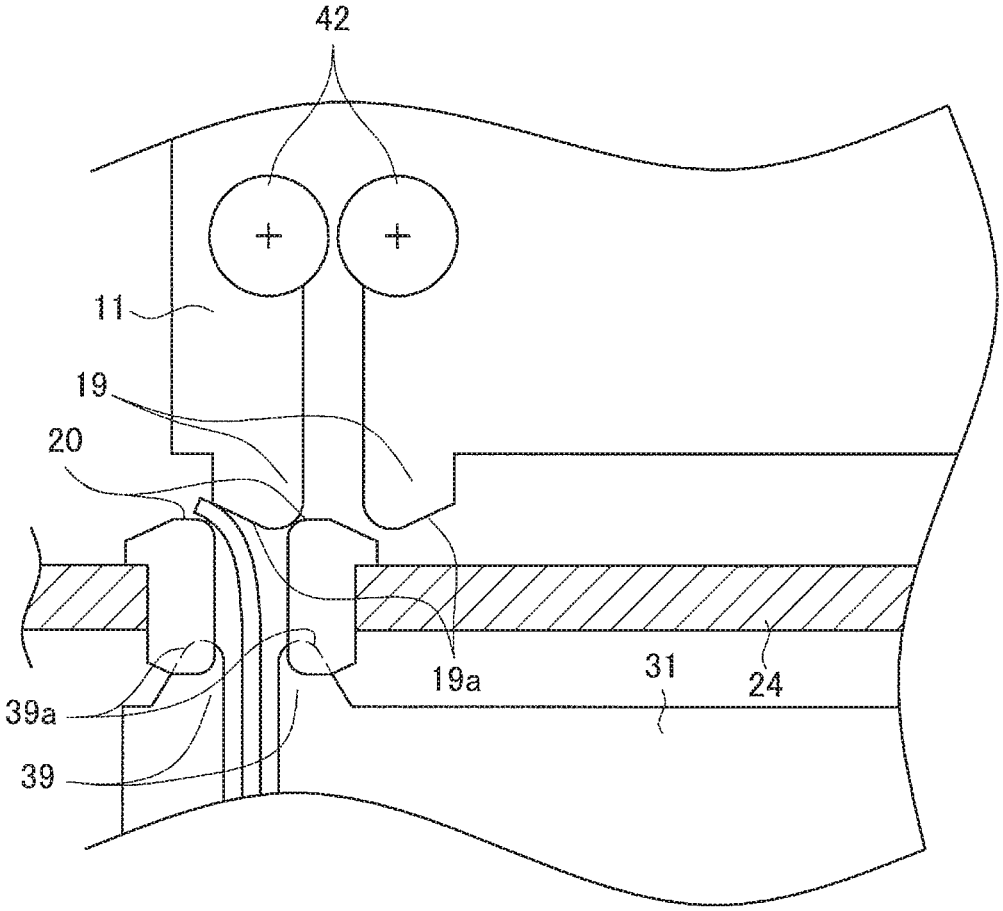
FIG. 12 is an explanatory diagram illustrating action of upper guides of a banknote processing apparatus 1 according to an application example.

According to this configuration, it is possible to reduce occurrence of part damage involved by movement of the upper unit 10 or the lower unit 30. For example, as illustrated in FIG. 12, when a staff puts the drawn out upper unit 11 back into place in the banknote processing apparatus 1 while there is the left-behind banknote 46 between the transfer guides 20, the left-behind banknote 46 may be sandwiched between the transfer guides 20 and the edge 19*a* of the upper guide 19. However, the edge 19*a* of the upper guide 19 is the inclined surface having the angle of 30 degrees or less with respect to the horizontal direction, for example. Therefore, the left-behind banknote 46 deforms, and a component force applied to the edge 19*a* of the upper guide 19 by a horizontal force to press the upper unit 11 is eased. As a result, a force to sandwich the left-behind banknote 46 between the transfer guides 20 and the upper guide 19 becomes weaker than the comparative example described with reference to FIG. 10. Accordingly, a force to mutually pull the transfer guides 20 and the upper guide 19 via the left-behind banknote 46 in the case where the upper unit 11 is further pushed also becomes weak. Therefore, it is possible to reduce bow of the upper guide 19 and occurrence of part damage of the upper guide 19.

The example in which the staff puts the upper unit 11 back into place in the banknote processing apparatus 1 while there is the left-behind banknote 46 between the transfer guides 20 has been described. In addition, it is also possible to reduce bow of the lower guide 39 and occurrence of part damage of the lower guide 39 due to action of the edge 39*a* of the lower guide 39 similar to the action of the edge 19*a* of the upper guide 19, in the case where the staff puts the lower unit 31 back into place in the banknote processing apparatus 1 while there is the left-behind banknote 46 between the transfer guides 20.

Note that, each of the edges 19*a* of the upper guide 19 and the edges 39*a* of the lower guides 39 may have a curved surface shape instead of the inclined surface. According to this configuration, it is also possible to ease the force to sandwich the left-behind banknote 46, and to reduce bow of the upper guide 19 and the lower guide 39 and occurrence of part damage of the upper guide 19 and the lower guide 39.

As illustrated in FIG. 11 and FIG. 12, each of the upper guide 19 at the front surface side and the upper guide 19 at the back surface side has the edge 19*a* at an opposite side to the conveyance path side and at the transfer guides 20 side, the edge 19*a* coming closer to the conveyance path as the edge 19*a* nears the transfer guides 20 side. In a similar way, each of the lower guide 39 at the front surface side and the lower guide 39 at the back surface side has the edge 39*a* at an opposite side to the conveyance path side and at the transfer guides 20 side, the edge 39*a* coming closer to the conveyance path as the edge 39*a* nears the transfer guides 20 side. According to this configuration, it is also possible to reduce bow of the upper guides 19 and the lower guides 39 and occurrence of part damage of the upper guides 19 and the lower guides 39 in the case where the upper unit 10 and the lower unit 30 can be drawn out toward the front side of the banknote processing apparatus 1.

<4. Conclusion>

As described above, the modified shapes of the transfer guides 20, the upper guides 18 (19), and the lower guides 38 (39) according to the embodiments of the present invention can reduce occurrence of part damage involved by movement of a unit.

Heretofore, preferred embodiments of the present invention have been described in detail with reference to the appended drawings, but the present invention is not limited thereto. It should be understood by those skilled in the art that various changes and alterations may be made without departing from the spirit and scope of the appended claims. It should be understood that such modifications or variations are also within the technical scope of the present disclosure.

For example, although the example in which the transfer guides 20 are fixed to the safe 24 has been described, movable transfer guides 20 may be provided in the banknote processing apparatus 1. In addition, although the example in which the upper unit 10 includes the customer interface section 13, the classification section 14, the temporary holding section 15, and the reject container 16 and the lower unit 30 includes the banknote cassettes 32A to 32E has been described, structural elements included in the upper unit 10 and the lower unit 30 are not limited thereto. For example, the lower unit 30 may include the classification section 14, the temporary holding section 15, and the reject container 16.

REFERENCE SIGNS LIST

1 banknote processing apparatus
2 casing
10, 11 upper unit
13 customer interface section
14 classification section
15 temporary holding section
16 reject container
17 upper conveyance section
18, 19 upper guide
19*a* edge
20 transfer guide
21 fixed section
22 guide piece
24 safe
26 upper edge
27 lower edge
28 transfer conveyance path
30, 31 lower unit
32 banknote cassette
37 lower conveyance section
38, 39 lower guide
39*a* edge
42 conveyance roller
44 left-behind sensor
50 opening
52 screw hole

The invention claimed is:

1. A banknote processing apparatus, comprising:

a first unit including a pair of first guides that are configured to form a first portion of a transfer conveyance path therebetween;

a second unit that is movable with respect to the first unit in a first direction; and a pair of transfer guides configured to form a second portion of the transfer conveyance path therebetween, a banknote being conveyed between the first unit and the second unit through the first and second portions of the transfer conveyance path in a second direction that is orthogonal to the first direction, the pair of transfer guides being nested with the pair of first guides in a width direction of the transfer conveyance path, the width direction being orthogonal to both of the first direction and the second direction, each of the transfer guides having a plurality of guide pieces that are separately disposed to each other in the width direction of the transfer conveyance path, each of the guide pieces having a first transfer guide edge portion facing in a direction of a corresponding one of the pair of first guides when the first portion of the transfer conveyance path is in registration with the second portion of the transfer conveyance path, the first transfer guide edge portion having an upper edge and a lower edge, the upper edge being disposed closer, in the first direction, to the second portion of the transfer conveyance path than the lower edge when the first portion of the transfer conveyance path is in registration with the second portion of the transfer conveyance path, the upper edge being closer to the corresponding one of the pair of the first guides than the lower edge, a position of a lowermost edge of each of the first guides being located, in the second direction, at a positional height between an uppermost edge of the first transfer guide edge portion and the lower edge of the first transfer guide edge portion, the lowermost edge being a portion of each of the first guides closest to the second unit, the uppermost edge being a portion of each of the first transfer guide edge portions closest to the first unit.

2. The banknote processing apparatus according to claim 1, wherein the second unit includes a pair of second guides configured to form a third portion of the transfer conveyance path therebetween, the pair of second guides being nested with the pair of transfer guides in the width direction of the transfer conveyance path, each of the transfer guides has a second transfer guide edge portion facing in a direction of a corresponding one of the pair of second guides when the second portion of the transfer conveyance path is in registration with the third portion of the transfer conveyance path, the second transfer guide edge portion having an upper edge and a lower edge, the upper edge being disposed farther, in the first direction, from the second portion of the transfer conveyance path than the lower edge, the upper edge being farther from the corresponding one of the pair of second guides than the lower edge when the second portion of the transfer conveyance path is in registration with the third portion of the transfer conveyance path, and a positon of an uppermost edge of each of the second guides is located, in the second direction, at a positional height between a lowermost edge of the second transfer guide edge portion and the upper edge of the second transfer guide edge portion, the uppermost edge being a portion of each of the second guides closest to the first unit, the lowermost edge being a portion of each of the second transfer guide edge portions closest to the second unit.

3. The banknote processing apparatus according to claim 2, wherein the first transfer guide edge portion or the second transfer guide edge portion has an inclined surface between the upper edge and the lower edge thereof, the inclined surface having an angle of 60 degrees or more in the first direction.

4. The banknote processing apparatus according to claim 1, wherein each first guide has a first guide edge portion facing in a direction of a corresponding first transfer guide edge portion when the first portion of the transfer conveyance path is in registration with the second portion of the transfer conveyance path, the first guide edge portion having an upper edge and a lower edge, the upper edge being disposed farther, in the first direction, from the first portion of the transfer conveyance path than the lower edge, the upper edge being farther from the corresponding first transfer guide edge portion than the lower edge when the first portion of the transfer conveyance path is in registration with the second portion of the transfer conveyance path.

5. The banknote processing apparatus according to claim 4, wherein the first guide edge portion has an inclined surface between the upper edge and the lower edge thereof, the inclined surface having an angle of 60 degrees or more.

6. The banknote processing apparatus according to claim 1, wherein the second unit includes a pair of second guides configured to form a third portion of the transfer conveyance path therebetween, the pair of second guides being nested with the pair of the transfer guides in the width direction of the transfer conveyance path, and wherein each of the second guides has a second guide edge portion facing in a direction of a corresponding second transfer guide edge portion when the second portion of the transfer conveyance path is in registration with the third portion of the transfer conveyance path, the second guide edge portion having an upper edge and a lower edge, the upper edge being disposed closer, in the first direction, to the third portion of the transfer conveyance path than the lower edge, the upper edge being closer to the corresponding second transfer guide edge portion than the lower edge when the second portion of the transfer conveyance path is in registration with the third portion of the transfer conveyance path.

7. The banknote processing apparatus according to claim 6, wherein the second guide edge portion has an inclined surface between the upper edge and the lower edge thereof, the inclined surface having an angle of 60 degrees or more in the first direction.

8. The banknote processing apparatus according to claim 1, wherein the first unit and the second unit are separable from the pair of transfer guides and movable in the first direction.

9. The banknote processing apparatus according to claim 1, wherein one of the first unit and the second unit includes a customer interface section configured to transfer a banknote between a customer and the banknote processing apparatus, and wherein the other of the first unit and the second unit includes a plurality of banknote storage sections configured to store banknotes.

10. A banknote processing apparatus, comprising:

a first unit including a frame and a pair of first guides that project outward from the frame, the pair of the first guides being configured to form a first portion of a transfer conveyance path therebetween, each of the pair of first guides being immovably formed relative to the frame;

a second unit that is movable with respect to the first unit in a first direction;

a body frame that accommodates the second unit; and a pair of transfer guides that are immovably fixed to the body frame and are configured to form a second portion of the transfer conveyance path therebetween, a banknote being conveyed between the first unit and the second unit through the first and second portions of the transfer conveyance path in a second direction that is orthogonal to the first direction, the pair of transfer guides being nested with the pair of first guides in a width direction of the transfer conveyance path, the width direction being orthogonal to both of the first direction and the second direction, each of the transfer guides having a first transfer guide edge portion facing in a direction of a corresponding one of the pair of first guides when the first portion of the transfer conveyance path is in registration with the second portion of the transfer conveyance path, the first transfer guide edge portion having an upper edge and a lower edge, the upper edge being disposed closer, in the first direction, to the second portion of the transfer conveyance path than the lower edge, the upper edge being closer to the corresponding one of the pair of the first guides than the lower edge when the first portion of the transfer conveyance path is in registration with the second portion of the transfer conveyance path, only a part of a position, in the second direction, of an edge portion of each of the first guides overlapping with a part of a position of the first transfer guide edge portion.

11. The banknote processing apparatus according to claim 10, wherein the second unit includes a pair of second guides configured to form a third portion of the transfer conveyance path therebetween, the pair of second guides being nested with the pair of transfer guides in the width direction of the transfer conveyance path, each of the transfer guides has a second transfer guide edge portion facing a corresponding one of the pair of second guides when the second portion of the transfer conveyance path is in registration with the third portion of the transfer conveyance path, the second transfer guide edge portion having an upper edge and a lower edge, the upper edge being disposed farther, in the first direction, from the second portion of the transfer conveyance path than the lower edge, the upper edge being farther from the corresponding one of the pair of second guides than the lower edge when the second portion of the transfer conveyance path is in registration with the third portion of the transfer conveyance path, and only a part of a position, in the second direction, of an edge portion of each of the second guides overlapping with a part of a position of the second transfer guide edge portion.

* * * * *